US007117957B2

(12) United States Patent
Metcalfe et al.

(10) Patent No.: US 7,117,957 B2
(45) **Date of Patent: *Oct. 10, 2006**

(54) METHODS FOR DRILLING AND LINING A WELLBORE

(75) Inventors: Paul David Metcalfe, Peterculter (GB); Neil Andrew Abercrombie Simpson, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/853,498

(22) Filed: May 25, 2004

(65) Prior Publication Data

US 2004/0216925 A1 Nov. 4, 2004

Related U.S. Application Data

(63) Continuation of application No. 10/364,718, filed on Feb. 11, 2003, now Pat. No. 6,742,606, which is a continuation of application No. 09/469,643, filed on Dec. 22, 1999, now Pat. No. 6,543,552.

(30) Foreign Application Priority Data

| | | |
|---|---|---|
| Dec. 22, 1998 | (GB) | 9828234.6 |
| Jan. 15, 1999 | (GB) | 9900835.1 |
| Oct. 8, 1999 | (GB) | 9923783.6 |
| Oct. 13, 1999 | (GB) | 9924189.5 |

(51) Int. Cl.

| | |
|---|---|
| ***E21B 7/00*** | (2006.01) |
| ***E21B 7/20*** | (2006.01) |
| ***E21B 23/00*** | (2006.01) |
| ***B21B 41/02*** | (2006.01) |

(52) U.S. Cl. ..... 175/57; 175/171; 175/258; 166/208; 166/212; 166/277; 166/382; 72/393

(58) Field of Classification Search ..... 72/97, 72/150, 148, 343, 75; 166/277, 382, 206, 166/384, 207, 208, 212, 217, 98; 175/23, 175/57, 171, 258

See application file for complete search history.

(56) References Cited

U.S. PATENT DOCUMENTS

| | | | |
|---|---|---|---|
| 122,514 | A | 1/1872 | Bullock |
| 1,077,772 | A | 11/1913 | Weathersby |
| 1,185,582 | A | 5/1916 | Bignell |
| 1,301,285 | A | 4/1919 | Leonard |

(Continued)

FOREIGN PATENT DOCUMENTS

| | | |
|---|---|---|
| CA | 2 335 192 | 11/2001 |

(Continued)

OTHER PUBLICATIONS

Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.

(Continued)

*Primary Examiner*—Jennifer H. Gay
(74) *Attorney, Agent, or Firm*—Patterson & Sheridan, L.L.P.

(57) ABSTRACT

A method includes drilling and lining a wellbore, in one aspect by mounting a drill bit on a drill string including a section of expandable tubing and providing a tubing expander in the string, rotating the drill bit and advancing the drill string through a bore, and passing the expander through the expandable tubing to expand the tubing. The apparatus comprises a drill string including a section of expandable tubing, a drill bit mounted on the string, and a tubing expander mounted on the string.

49 Claims, 4 Drawing Sheets

U.S. PATENT DOCUMENTS

| | | | | |
|---|---|---|---|---|
| 1,342,424 | A | | 6/1920 | Cotten |
| 1,418,766 | A | | 6/1922 | Wilson |
| 1,471,526 | A | | 10/1923 | Pickin |
| 1,585,069 | A | | 5/1926 | Youle |
| 1,728,136 | A | | 9/1929 | Power |
| 1,777,592 | A | | 10/1930 | Thomas |
| 1,825,026 | A | | 9/1931 | Thomas |
| 1,830,625 | A | | 11/1931 | Schrock |
| 1,842,638 | A | | 1/1932 | Wigle |
| 1,880,218 | A | | 10/1932 | Simmons |
| 1,917,135 | A | | 7/1933 | Littell |
| 1,981,525 | A | * | 11/1934 | Price ..... 166/381 |
| 1,998,833 | A | | 4/1935 | Crowell |
| 2,017,451 | A | | 10/1935 | Wickersham |
| 2,049,450 | A | | 8/1936 | Johnson |
| 2,060,352 | A | | 11/1936 | Stokes |
| 2,105,885 | A | | 1/1938 | Hinderliter |
| 2,167,338 | A | | 7/1939 | Murcell |
| 2,214,226 | A | | 9/1940 | English |
| 2,214,429 | A | | 9/1940 | Miller |
| 2,216,895 | A | | 10/1940 | Stokes |
| 2,228,503 | A | | 1/1941 | Boyd et al. |
| 2,295,803 | A | | 9/1942 | O'Leary |
| 2,305,062 | A | | 12/1942 | Church et al. |
| 2,324,679 | A | | 7/1943 | Cox |
| 2,370,832 | A | | 3/1945 | Baker |
| 2,379,800 | A | | 7/1945 | Hare |
| 2,383,214 | A | | 8/1945 | Prout |
| 2,414,719 | A | | 1/1947 | Cloud |
| 2,424,878 | A | | 7/1947 | Crook |
| 2,499,630 | A | | 3/1950 | Clark |
| 2,519,116 | A | | 8/1950 | Crake |
| 2,522,444 | A | | 9/1950 | Grable |
| 2,536,458 | A | | 1/1951 | Munsinger |
| 2,610,690 | A | | 9/1952 | Beatty |
| 2,621,742 | A | | 12/1952 | Brown |
| 2,627,891 | A | | 2/1953 | Clark |
| 2,633,374 | A | | 3/1953 | Boice |
| 2,641,444 | A | | 6/1953 | Moon |
| 2,650,314 | A | | 8/1953 | Hennigh et al. |
| 2,663,073 | A | | 12/1953 | Bieber et al. |
| 2,668,689 | A | | 2/1954 | Cormany |
| 2,692,059 | A | | 10/1954 | Bolling, Jr. |
| 2,720,267 | A | | 10/1955 | Brown |
| 2,738,011 | A | | 3/1956 | Mabry |
| 2,741,907 | A | | 4/1956 | Genender et al. |
| 2,743,087 | A | | 4/1956 | Layne et al. |
| 2,743,495 | A | | 5/1956 | Eklund |
| 2,764,329 | A | | 9/1956 | Hampton |
| 2,765,146 | A | | 10/1956 | Williams |
| 2,805,043 | A | | 9/1957 | Williams |
| 2,898,971 | A | | 8/1959 | Hempel |
| 2,953,406 | A | | 9/1960 | Young |
| 2,978,047 | A | | 4/1961 | DeVaan |
| 3,006,415 | A | | 10/1961 | Burns et al. |
| 3,028,915 | A | | 4/1962 | Jennings |
| 3,039,530 | A | | 6/1962 | Condra |
| 3,041,901 | A | | 7/1962 | Knights |
| 3,054,100 | A | | 9/1962 | Jones |
| 3,087,546 | A | | 4/1963 | Wooley |
| 3,090,031 | A | | 5/1963 | Lord |
| 3,102,599 | A | | 9/1963 | Hillburn |
| 3,111,179 | A | | 11/1963 | Albers et al. |
| 3,117,636 | A | | 1/1964 | Wilcox et al. |
| 3,122,811 | A | | 3/1964 | Gilreath |
| 3,123,160 | A | | 3/1964 | Kammerer |
| 3,124,023 | A | | 3/1964 | Marquis et al. |
| 3,131,769 | A | | 5/1964 | Rochemont |
| 3,159,219 | A | | 12/1964 | Scott |
| 3,167,122 | A | | 1/1965 | Lang |
| 3,169,592 | A | | 2/1965 | Kammerer |
| 3,179,168 | A | | 4/1965 | Vincent |
| 3,186,485 | A | | 6/1965 | Owen |
| 3,191,677 | A | | 6/1965 | Kinley |
| 3,191,680 | A | | 6/1965 | Vincent |
| 3,193,116 | A | | 7/1965 | Kenneday et al. |
| 3,195,646 | A | | 7/1965 | Brown |
| 3,203,451 | A | | 8/1965 | Vincent |
| 3,203,483 | A | | 8/1965 | Vincent |
| 3,245,471 | A | | 4/1966 | Howard |
| 3,297,092 | A | | 1/1967 | Jennings |
| 3,326,293 | A | | 6/1967 | Skipper |
| 3,353,599 | A | | 11/1967 | Swift |
| 3,354,955 | A | | 11/1967 | Berry |
| 3,380,528 | A | | 4/1968 | Timmons |
| 3,387,893 | A | | 6/1968 | Hoever |
| 3,392,609 | A | | 7/1968 | Bartos |
| 3,419,079 | A | | 12/1968 | Current |
| 3,467,180 | A | | 9/1969 | Pensotti |
| 3,477,506 | A | | 11/1969 | Malone |
| 3,477,527 | A | | 11/1969 | Koot |
| 3,489,220 | A | | 1/1970 | Kinley |
| 3,518,903 | A | | 7/1970 | Ham et al. |
| 3,548,936 | A | | 12/1970 | Kilgore et al. |
| 3,550,684 | A | | 12/1970 | Cubberly, Jr. |
| 3,552,507 | A | | 1/1971 | Brown |
| 3,552,508 | A | | 1/1971 | Brown |
| 3,552,509 | A | | 1/1971 | Brown |
| 3,552,510 | A | | 1/1971 | Brown |
| 3,552,848 | A | | 1/1971 | Van Wagner |
| 3,559,739 | A | | 2/1971 | Hutchison |
| 3,566,505 | A | | 3/1971 | Martin |
| 3,570,598 | A | | 3/1971 | Johnson |
| 3,575,245 | A | | 4/1971 | Cordary et al. |
| 3,583,200 | A | | 6/1971 | Cvijanovic et al. |
| 3,602,302 | A | | 8/1971 | Kluth |
| 3,603,411 | A | | 9/1971 | Link |
| 3,603,412 | A | | 9/1971 | Kammerer, Jr. et al. |
| 3,603,413 | A | | 9/1971 | Grill et al. |
| 3,606,664 | A | | 9/1971 | Weiner |
| 3,624,760 | A | | 11/1971 | Bodine |
| 3,635,105 | A | | 1/1972 | Dickmann et al. |
| 3,656,564 | A | | 4/1972 | Brown |
| 3,662,842 | A | | 5/1972 | Bromell |
| 3,669,190 | A | | 6/1972 | Sizer et al. |
| 3,680,412 | A | | 8/1972 | Mayer et al. |
| 3,689,113 | A | | 9/1972 | Blaschke |
| 3,691,624 | A | | 9/1972 | Kinley |
| 3,691,825 | A | | 9/1972 | Dyer |
| 3,692,126 | A | | 9/1972 | Rushing et al. |
| 3,696,332 | A | | 10/1972 | Dickson, Jr. et al. |
| 3,700,048 | A | | 10/1972 | Desmoulins |
| 3,712,376 | A | | 1/1973 | Owen et al. |
| 3,729,057 | A | | 4/1973 | Werner |
| 3,746,091 | A | | 7/1973 | Owen et al. |
| 3,746,330 | A | | 7/1973 | Taciuk |
| 3,747,675 | A | | 7/1973 | Brown |
| 3,760,894 | A | | 9/1973 | Pitifer |
| 3,776,307 | A | | 12/1973 | Young |
| 3,776,320 | A | | 12/1973 | Brown |
| 3,776,991 | A | | 12/1973 | Marcus |
| 3,780,562 | A | | 12/1973 | Kinley |
| 3,785,193 | A | | 1/1974 | Kinley et al. |
| 3,808,916 | A | | 5/1974 | Porter et al. |
| 3,818,734 | A | | 6/1974 | Bateman |
| 3,820,370 | A | | 6/1974 | Duffy |
| 3,838,613 | A | | 10/1974 | Wilms |
| 3,840,128 | A | | 10/1974 | Swoboda, Jr. et al. |
| 3,848,684 | A | | 11/1974 | West |
| 3,857,450 | A | | 12/1974 | Guier |
| 3,870,114 | A | | 3/1975 | Pulk et al. |
| 3,881,375 | A | | 5/1975 | Kelly |
| 3,885,298 | A | | 5/1975 | Pogonowski |
| 3,885,679 | A | | 5/1975 | Swoboda, Jr. et al. |

3,901,331 A 8/1975 Djurovic
3,911,707 A 10/1975 Minakov et al.
3,913,687 A 10/1975 Gyongyosi et al.
3,915,244 A 10/1975 Brown
3,934,660 A 1/1976 Nelson
3,945,444 A 3/1976 Knudson
3,947,009 A 3/1976 Nelmark
3,948,321 A 4/1976 Owen et al.
3,964,556 A 6/1976 Gearhart et al.
3,977,076 A 8/1976 Vieira et al.
3,980,143 A 9/1976 Swartz et al.
4,049,066 A 9/1977 Richey
4,054,332 A 10/1977 Bryan, Jr.
4,054,426 A 10/1977 White
4,064,939 A 12/1977 Marquis
4,069,573 A 1/1978 Rogers, Jr. et al.
4,077,525 A 3/1978 Callegari et al.
4,082,144 A 4/1978 Marquis
4,083,405 A 4/1978 Shirley
4,085,808 A 4/1978 Kling
4,095,865 A 6/1978 Denison et al.
4,100,968 A 7/1978 Delano
4,100,981 A 7/1978 Chaffin
4,127,168 A 11/1978 Hanson et al.
4,127,927 A 12/1978 Hauk et al.
4,133,396 A 1/1979 Tschirky
4,142,739 A 3/1979 Billingsley
4,159,564 A 7/1979 Cooper, Jr.
4,173,457 A 11/1979 Smith
4,175,619 A 11/1979 Davis
4,186,628 A 2/1980 Bonnice
4,189,185 A 2/1980 Kammerer, Jr. et al.
4,194,383 A 3/1980 Huzyak
4,221,269 A 9/1980 Hudson
4,227,197 A 10/1980 Nimmo et al.
4,241,878 A 12/1980 Underwood
4,257,442 A 3/1981 Claycomb
4,262,693 A 4/1981 Giebeler
4,274,777 A 6/1981 Scaggs
4,274,778 A 6/1981 Putnam et al.
4,277,197 A 7/1981 Bingham
4,280,380 A 7/1981 Eshghy
4,281,722 A 8/1981 Tucker et al.
4,287,949 A 9/1981 Lindsey, Jr.
4,288,082 A 9/1981 Setterberg, Jr.
4,311,195 A 1/1982 Mullins, II
4,315,553 A 2/1982 Stallings
4,319,393 A 3/1982 Pogonowski
4,320,915 A 3/1982 Abbott et al.
4,324,407 A 4/1982 Upham et al.
4,336,415 A 6/1982 Walling
4,349,050 A 9/1982 Bergstrom et al.
4,359,889 A 11/1982 Kelly
4,362,324 A 12/1982 Kelly
4,382,379 A 5/1983 Kelly
4,384,627 A 5/1983 Ramirez-Jauregui
4,387,502 A 6/1983 Dom
4,392,534 A 7/1983 Miida
4,396,076 A 8/1983 Inoue
4,396,077 A 8/1983 Radtke
4,407,150 A 10/1983 Kelly
4,407,378 A 10/1983 Thomas
4,408,669 A 10/1983 Wiredal
4,413,682 A 11/1983 Callihan et al.
4,414,739 A 11/1983 Kelly
4,427,063 A 1/1984 Skinner
4,429,620 A 2/1984 Burkhardt et al.
4,437,363 A 3/1984 Haynes
4,440,220 A 4/1984 McArthur
4,445,201 A 4/1984 Pricer
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,470,280 A 9/1984 Kelly
4,470,470 A 9/1984 Takano
4,472,002 A 9/1984 Beney et al.
4,474,243 A 10/1984 Gaines
4,483,399 A 11/1984 Colgate
4,487,630 A 12/1984 Crook et al.
4,489,793 A 12/1984 Boren
4,489,794 A 12/1984 Boyadjieff
4,492,134 A 1/1985 Reinholdt et al.
4,494,424 A 1/1985 Bates
4,502,308 A 3/1985 Kelly
4,505,142 A 3/1985 Kelly
4,505,612 A 3/1985 Shelley, Jr.
4,515,045 A 5/1985 Gnatchenko et al.
4,529,045 A 7/1985 Boyadjieff et al.
4,531,581 A 7/1985 Pringle et al.
4,544,041 A 10/1985 Rinaldi
4,545,443 A 10/1985 Wiredal
4,567,631 A 2/1986 Kelly
4,570,706 A 2/1986 Pugnet
4,580,631 A 4/1986 Baugh
4,581,617 A 4/1986 Yoshimoto et al.
4,583,603 A 4/1986 Dorleans et al.
4,588,030 A 5/1986 Blizzard
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,620,600 A 11/1986 Persson
4,625,796 A 12/1986 Boyadjieff
4,626,129 A 12/1986 Kothmann et al.
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,697,640 A 10/1987 Szarka
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,750,559 A 6/1988 Greenlee et al.
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,778,008 A 10/1988 Gonzalez et al.

4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,807,704 A 2/1989 Hsu et al.
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,866,966 A 9/1989 Hagen
4,867,236 A 9/1989 Haney et al.
4,878,546 A 11/1989 Shaw et al.
4,880,058 A 11/1989 Lindsey et al.
4,883,121 A 11/1989 Zwart
4,883,125 A 11/1989 Wilson et al.
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,976,322 A 12/1990 Abdrakhmanov et al.
4,997,042 A 3/1991 Jordan et al.
4,997,320 A 3/1991 Hwang
5,009,265 A 4/1991 Bailey et al.
5,014,779 A 5/1991 Meling et al.
5,022,472 A 6/1991 Bailey et al.
5,027,914 A 7/1991 Wilson
5,036,927 A 8/1991 Willis
5,049,020 A 9/1991 McArthur
5,052,483 A 10/1991 Hudson
5,052,849 A 10/1991 Zwart
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,085,273 A 2/1992 Coone
5,096,465 A 3/1992 Chen et al.
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,209 A 10/1992 McHardy
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,267,613 A 12/1993 Zwart et al.
5,271,468 A 12/1993 Streich et al.
5,271,472 A * 12/1993 Leturno ..... 175/107
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,301,760 A 4/1994 Graham
5,305,830 A 4/1994 Wittrisch
5,305,839 A 4/1994 Kalsi et al.
5,307,879 A 5/1994 Kent
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,366,012 A 11/1994 Lohbeck
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,409,059 A 4/1995 McHardy
5,433,279 A 7/1995 Tassari et al.
5,435,400 A * 7/1995 Smith ..... 175/61
5,452,923 A 9/1995 Smith
5,456,317 A 10/1995 Hood, III et al.
5,458,209 A 10/1995 Hayes et al.
5,461,905 A 10/1995 Penisson
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,426 A 10/1996 Trahan et al.
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr 5,584,343 A 12/1996 Coone
5,588,916 A 12/1996 Moore
5,613,567 A 3/1997 Hudson
5,615,747 A 4/1997 Vail, III
5,636,661 A 6/1997 Moyes
5,645,131 A 7/1997 Trevisani
5,651,420 A 7/1997 Tibbitts et al.
5,661,888 A 9/1997 Hanslik
5,662,170 A * 9/1997 Donovan et al. ..... 166/358
5,662,182 A 9/1997 McLeod et al.
5,667,011 A 9/1997 Gill et al.
5,667,023 A 9/1997 Harrell et al.
5,667,026 A 9/1997 Lorenz et al.
5,685,369 A 11/1997 Ellis et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,772,514 A 6/1998 Moore
5,785,120 A 7/1998 Smalley et al.
5,785,132 A 7/1998 Richardson et al.
5,785,134 A 7/1998 McLeod et al.
5,787,978 A 8/1998 Carter et al.
5,791,410 A 8/1998 Castille et al.
5,794,703 A 8/1998 Newman et al.
5,803,191 A 9/1998 Mackintosh
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,901,787 A 5/1999 Boyle
5,901,789 A 5/1999 Donnelly et al.
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,924,745 A 7/1999 Campbell
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,960,895 A 10/1999 Chevallier et al.
5,971,079 A 10/1999 Mullins
5,971,086 A 10/1999 Bee et al.
5,979,571 A 11/1999 Scott et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,021,850 A 2/2000 Wood et al.
6,024,169 A 2/2000 Haugen
6,026,911 A 2/2000 Angle et al.
6,029,748 A 2/2000 Forsyth et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,089,323 A 7/2000 Newman et al.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,273,189 B1 8/2001 Gissler et al.
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,343,649 B1 2/2002 Beck et al.
6,347,674 B1 2/2002 Bloom et al.
6,349,764 B1 2/2002 Adams et al.
6,357,485 B1 3/2002 Quigley et al.
6,359,569 B1 3/2002 Beck et al.
6,360,633 B1 3/2002 Pietras
6,367,552 B1 4/2002 Scott et al.
6,367,566 B1 4/2002 Hill
6,371,203 B1 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.

6,378,633 B1 4/2002 Moore
6,390,190 B1 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,425,444 B1 7/2002 Metcalfe et al.
6,427,776 B1 8/2002 Hoffman et al.
6,429,784 B1 8/2002 Beique et al.
6,431,626 B1 8/2002 Bouligny
6,443,241 B1 9/2002 Juhasz et al.
6,443,247 B1 9/2002 Wardley
6,446,323 B1 9/2002 Metcalfe et al.
6,446,723 B1 9/2002 Ramons et al.
6,457,532 B1 10/2002 Simpson
6,458,471 B1 10/2002 Lovato et al.
6,464,004 B1 10/2002 Crawford et al.
6,464,011 B1 10/2002 Tubel
6,484,818 B1 11/2002 Alft et al.
6,497,280 B1 12/2002 Beck et al.
6,527,047 B1 3/2003 Pietras
6,527,049 B1 3/2003 Metcalfe et al.
6,527,064 B1 3/2003 Hallundbaek
6,527,493 B1 3/2003 Kamphorst et al.
6,536,520 B1 3/2003 Snider et al.
6,536,522 B1 3/2003 Birckhead et al.
6,536,993 B1 3/2003 Strong et al.
6,538,576 B1 3/2003 Schultz et al.
6,540,025 B1 4/2003 Scott et al.
6,543,552 B1 * 4/2003 Metcalfe et al. ..... 175/57
6,547,017 B1 4/2003 Vail, III
6,553,825 B1 4/2003 Boyd
6,554,064 B1 4/2003 Restarick et al.
6,585,040 B1 7/2003 Hanton et al.
6,591,471 B1 7/2003 Hollingsworth et al.
6,595,288 B1 7/2003 Mosing et al.
6,619,402 B1 9/2003 Amory et al.
6,622,796 B1 9/2003 Pietras
6,634,430 B1 10/2003 Dawson et al.
6,637,526 B1 10/2003 Juhasz et al.
6,648,075 B1 11/2003 Badrak et al.
6,651,737 B1 11/2003 Bouligny
6,655,460 B1 12/2003 Bailey et al.
6,666,274 B1 12/2003 Hughes
6,668,684 B1 12/2003 Allen et al.
6,668,937 B1 12/2003 Murray
6,679,333 B1 1/2004 York et al.
6,688,394 B1 2/2004 Ayling
6,688,398 B1 2/2004 Pietras
6,691,801 B1 2/2004 Juhasz et al.
6,698,595 B1 * 3/2004 Norell et al. ..... 210/499
6,702,029 B1 3/2004 Metcalfe et al.
6,702,040 B1 3/2004 Sensenig
6,708,769 B1 3/2004 Haugen et al.
6,715,430 B1 4/2004 Choi et al.
6,719,071 B1 4/2004 Moyes
6,725,924 B1 4/2004 Davidson et al.
6,725,938 B1 4/2004 Pietras
6,732,822 B1 5/2004 Slack et al.
6,742,584 B1 6/2004 Appleton
6,742,596 B1 6/2004 Haugen
6,742,606 B1 * 6/2004 Metcalfe et al. ..... 175/57
6,745,834 B1 6/2004 Davis et al.
6,752,211 B1 6/2004 Dewey et al.
6,832,658 B1 12/2004 Keast
6,837,313 B1 1/2005 Hosie et al.
6,840,322 B1 1/2005 Haynes
6,848,517 B1 2/2005 Wardley
6,854,533 B1 2/2005 Galloway
6,857,486 B1 2/2005 Chitwood et al.
6,857,487 B1 2/2005 Galloway et al.
2001/0000101 A1 4/2001 Lovato et al.
2001/0002626 A1 6/2001 Frank et al.
2001/0013412 A1 8/2001 Tubel
2001/0040054 A1 11/2001 Haugen et al.
2001/0042625 A1 11/2001 Appleton
2001/0047883 A1 12/2001 Hanton et al.
2002/0040787 A1 4/2002 Cook et al.
2002/0066556 A1 6/2002 Goode et al.
2002/0074127 A1 6/2002 Birckhead et al.
2002/0074132 A1 6/2002 Juhasz et al.
2002/0079102 A1 6/2002 Dewey et al.
2002/0108748 A1 8/2002 Keyes
2002/0134555 A1 9/2002 Allen et al.
2002/0157829 A1 10/2002 Davis et al.
2002/0162690 A1 11/2002 Hanton et al.
2002/0170720 A1 11/2002 Haugen
2002/0189806 A1 12/2002 Davidson et al.
2002/0189863 A1 12/2002 Wardley
2003/0029641 A1 2/2003 Meehan
2003/0034177 A1 2/2003 Chitwood et al.
2003/0056947 A1 3/2003 Cameron
2003/0056991 A1 3/2003 Hahn et al.
2003/0070841 A1 4/2003 Merecka et al.
2003/0070842 A1 4/2003 Bailey et al.
2003/0111267 A1 6/2003 Pia
2003/0141111 A1 7/2003 Pia
2003/0146023 A1 8/2003 Pia
2003/0164250 A1 9/2003 Wardley
2003/0164251 A1 9/2003 Tulloch
2003/0164276 A1 9/2003 Snider et al.
2003/0173073 A1 9/2003 Snider et al.
2003/0173090 A1 9/2003 Cook et al.
2003/0213598 A1 11/2003 Hughes
2003/0217865 A1 11/2003 Simpson et al.
2003/0221519 A1 12/2003 Haugen et al.
2004/0000405 A1 1/2004 Fournier, Jr. et al.
2004/0003490 A1 1/2004 Shahin et al.
2004/0003944 A1 1/2004 Vincent et al.
2004/0011534 A1 1/2004 Simonds et al.
2004/0016575 A1 1/2004 Shahin et al.
2004/0060697 A1 4/2004 Tilton et al.
2004/0069500 A1 4/2004 Haugen
2004/0069501 A1 4/2004 Haugen et al.
2004/0079533 A1 4/2004 Buytaert et al.
2004/0108142 A1 6/2004 Vail, III
2004/0112603 A1 6/2004 Galloway et al.
2004/0112646 A1 6/2004 Vail
2004/0118613 A1 6/2004 Vail
2004/0118614 A1 6/2004 Galloway et al.
2004/0123984 A1 7/2004 Vail
2004/0124010 A1 7/2004 Galloway et al.
2004/0124011 A1 7/2004 Gledhill et al.
2004/0124015 A1 7/2004 Vaile et al.
2004/0129456 A1 7/2004 Vail
2004/0140128 A1 7/2004 Vail
2004/0144547 A1 7/2004 Koithan et al.
2004/0173358 A1 9/2004 Haugen
2004/0216878 A1 11/2004 Metcalfe et al.
2004/0216892 A1 11/2004 Giroux et al.
2004/0216924 A1 11/2004 Pietras et al.
2004/0216925 A1 11/2004 Metcalfe et al.
2004/0221997 A1 11/2004 Giroux et al.
2004/0226751 A1 11/2004 McKay et al.
2004/0244992 A1 12/2004 Carter et al.
2004/0245020 A1 12/2004 Giroux et al.
2004/0251025 A1 12/2004 Giroux et al.
2004/0251050 A1 12/2004 Shahin et al.
2004/0251055 A1 12/2004 Shahin et al.
2004/0262013 A1 12/2004 Tilton et al.
2005/0000691 A1 1/2005 Giroux et al.

2005/0096846 A1 5/2005 Koithan et al.

FOREIGN PATENT DOCUMENTS

| | | |
|---|---|---|
| DE | 3 213 464 | 10/1983 |
| DE | 3 523 221 | 2/1987 |
| DE | 3 918 132 | 12/1989 |
| DE | 4 133 802 | 10/1992 |
| EP | 0 087 373 | 8/1983 |
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 426 123 | 5/1991 |
| EP | 0 462 618 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 952 305 | 10/1999 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| FR | 2 741 907 | 11/1995 |
| FR | 2 841 293 | 12/2003 |
| GB | 540 027 | 10/1941 |
| GB | 709 365 | 5/1954 |
| GB | 716 761 | 10/1954 |
| GB | 730338 | 5/1955 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 457 843 | 12/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 170 528 | 8/1986 |
| GB | 2 201 912 | 9/1988 |
| GB | 2 216 926 | 10/1989 |
| GB | 2 223 253 | 4/1990 |
| GB | 2 224 481 | 9/1990 |
| GB | 2 240 799 | 8/1991 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 320 734 | 7/1998 |
| GB | 2 324 108 | 10/1998 |
| GB | 2 329 918 | 4/1999 |
| GB | 2 333 542 | 7/1999 |
| GB | 2 335 217 | 9/1999 |
| GB | 2 345 074 | 6/2000 |
| GB | 2 348 223 | 9/2000 |
| GB | 2347445 | 9/2000 |
| GB | 2 349 401 | 11/2000 |
| GB | 2 350 137 | 11/2000 |
| GB | 2 352 747 | 2/2001 |
| GB | 2 357 101 | 6/2001 |
| GB | 2 357 530 | 6/2001 |
| GB | 2 365 463 | 2/2002 |
| GB | 2 372 271 | 8/2002 |
| GB | 2 372 765 | 9/2002 |
| GB | 2 382 361 | 5/2003 |
| GB | 2381809 | 5/2003 |
| GB | 2 386 626 | 9/2003 |
| GB | 2 389 130 | 12/2003 |
| RU | 112631 | 1/1956 |
| RU | 247162 | 5/1967 |
| RU | 395557 | 12/1971 |
| RU | 415346 | 3/1972 |
| RU | 481689 | 6/1972 |
| RU | 461218 | 4/1973 |
| RU | 501139 | 12/1973 |
| RU | 585266 | 7/1974 |
| RU | 583278 | 8/1974 |
| RU | 601390 | 1/1976 |
| RU | 581238 | 2/1976 |
| RU | 655843 | 3/1977 |
| RU | 781312 | 3/1978 |
| RU | 899820 | 6/1979 |
| RU | 955765 | 2/1981 |
| RU | 1304470 | 8/1984 |
| RU | 1618870 | 1/1991 |
| RU | 1808972 | 5/1991 |
| RU | 2 079 633 | 5/1997 |
| WO | WO 90/06418 | 6/1990 |
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93/07358 | 4/1993 |
| WO | WO 93/24728 | 12/1993 |
| WO | WO 93/25800 | 12/1993 |
| WO | WO 94/25655 | 11/1994 |
| WO | WO 95/10686 | 4/1995 |
| WO | WO 96/18799 | 6/1996 |
| WO | WO 96/28635 | 9/1996 |
| WO | WO 97/05360 | 2/1997 |
| WO | WO 97/08418 | 3/1997 |
| WO | WO 97/21901 | 6/1997 |
| WO | WO 98/00626 | 1/1998 |
| WO | WO 98/01651 | 1/1998 |
| WO | WO 98/05844 | 2/1998 |
| WO | WO 98/09053 | 3/1998 |
| WO | WO 98/11322 | 3/1998 |
| WO | WO 98/32948 | 7/1998 |
| WO | WO 98/55730 | 12/1998 |
| WO | WO 99/02818 | 1/1999 |
| WO | WO 99/04135 | 1/1999 |
| WO | WO 99/11902 | 3/1999 |
| WO | WO 99/18328 | 4/1999 |
| WO | WO 99/23354 | 5/1999 |
| WO | WO 99/24689 | 5/1999 |
| WO | WO 99/35368 | 7/1999 |
| WO | WO 99/37881 | 7/1999 |
| WO | WO 99/41485 | 9/1999 |
| WO | WO 99/50528 | 10/1999 |
| WO | WO 99/58810 | 11/1999 |
| WO | WO 99/64713 | 12/1999 |
| WO | WO 00/04269 | 1/2000 |
| WO | WO 00/05483 | 2/2000 |
| WO | WO 00/08293 | 2/2000 |
| WO | WO 00/09853 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00/39429 | 7/2000 |
| WO | WO 00/39430 | 7/2000 |

| | | |
|---|---|---|
| WO | WO 00/41487 | 7/2000 |
| WO | WO 00/46484 | 8/2000 |
| WO | WO 00/50730 | 8/2000 |
| WO | WO 00/68879 | 11/2000 |
| WO | WO 01/12946 | 2/2001 |
| WO | WO 01/46550 | 6/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/14649 | 2/2002 |
| WO | WO 02/44601 | 6/2002 |
| WO | WO 02/081863 | 10/2002 |
| WO | WO 02/086287 | 10/2002 |
| WO | WO 03/006790 | 1/2003 |
| WO | WO 03/074836 | 9/2003 |
| WO | WO 03/087525 | 10/2003 |
| WO | WO 2004/022903 | 3/2004 |

OTHER PUBLICATIONS

M.B. Stone and J. Smith, "Expandable Tubulars and Casing Drilling are Options" Drilling Contractor, Jan./Feb. 2002, pp. 52.
M. Gelfgat, "Retractable Bits Development and Application" Transactions of the ASME, vol. 120, Jun. 1998, pp. 124-130.
"First Success with Casing-Drilling" World Oil, Feb. 1999, pp. 25.
Dean E. Gaddy, Editor, "Russia Shares Technical Know-How with U.S." Oil & Gas Journal, Mar. 1999, pp. 51-52 and 54-56.
U.S. Appl. No. 10/794,800, filed Mar. 4, 2004.
U.S. Appl. No. 10/832,804, filed Apr. 27, 2004.
U.S. Appl. No. 10/795,214, filed Mar. 5, 2004.
U.S. Appl. No. 10/794,795, filed Mar. 5, 2004.
U.S. Appl. No. 10/775,048, filed Feb. 9, 2004.
U.S. Appl. No. 10/772,217, filed Feb. 2, 2004.
U.S. Appl. No. 10/788,976, filed Feb. 27, 2004.
U.S. Appl. No. 10/794,797, filed Mar. 5, 2004.
U.S. Appl. No. 10/767,322, filed Jan. 29, 2004.
U.S. Appl. No. 10/795,129, filed Mar. 5, 2004.
U.S. Appl. No. 10/794,790, filed Mar. 5, 2004.
U.S. Appl. No. 10/162,302, filed Jun. 4, 2004.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
U.S. Appl. No. 10/618,093.
U.S. Appl. No. 10/189,570.
Tarr, et al., "Casing-while-Drilling: The Next Step Change In Well Construction," World Oil, Oct. 1999, pp. 34-40.
De Leon Mojarro, "Breaking a Paradigm: Drilling With Tubing Gas Wells," SPE Paper 40051, SPE Annual Technical Conference And Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Costs By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr. 1998, p. 65.
Tessari, et al., "Casing Drilling—A Revolutionary Approach To Reducing Well Costs," SPE/IADS Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drill Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shepard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing and Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono-Santos, et al., "Drilling With Casing Advances To Floating Drilling Unit With Surface BOP Employed," Paper WOCD-0307-01, World Oil Casing Drilling Technical Conferece, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Alexander Sas-Jaworsky and J. G. Williams, Development of Composite Coiled Tubing For Oilfield Services, SPE 26536, Society of Petroleum Engineers, Inc., 1993.
A. S. Jafar, H.H. Al-Attar, and I.S. El-Ageli, Discussion and Comparison of Performance of Horizontal Wells in Bouri Field, SPE 26927, Society of Petroleum Engineers, Inc. 1996.
G. F. Boykin, The Role of A Worldwide Drilling Organization and the Road to the Future, SPE/IADC 37630, 1997.
M. S. Fuller, M. Littler, and I. Pollock, Innovative Way To Cement a Liner Utitizing a New Inner String Liner Cementing Process, 1998.
Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Daigle, and Pat York, Using Expandable Solid Tubulars To Solve Well Construction Challenges in Deep Waters and Maturing Properities, IBP 27500, Brazilian Petroleum Institute—IBP, 2000.
Coiled Tubing Handbook, World Oil, Gulf Publishing Company, 1993.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, Inc., Autoseal Circulating Head, Engineering Manufacturing, 1992, 11 Pages.
Valves Wellhead Equipment Safety Systems, W-K-M Division, ACF Industries, Catalog 80, 1980, 5 Pages.
Canrig Top Drive Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, TESCO Drilling Technology, Apr. 1998, 2 pages.
500 or 650 HCIS Top Drive, Powerful Hydraulic Compact Top Drive Drilling System, TESCO Drilling Technology, Apr. 1998, 2 Pages.
Product Information (Sections 1-10) CANRIG Drilling Technology, Ltd., Sep. 18, 1996.

* cited by examiner

METHODS FOR DRILLING AND LINING A WELLBORE

CROSS-REFERENCE TO RELATED APPLICATIONS

This application is a continuation of U.S. patent application Ser. No. 10/364,718, filed Feb. 11, 2003, now U.S. Pat. No. 6,742,606, issued on Jun. 1, 2004. The aforementioned related patent application is herein incorporated by reference in its entirety. U.S. patent application Ser. No. 10/364,718, filed Feb. 11, 2003 is a continuation of U.S. patent application Ser. No. 09/469,643, filed Dec. 22, 1999, now U.S. Pat. No. 6,543,552, issued Apr. 8, 2003. U.S. Pat. No. 6,543,552 claims benefit under 35 U.S.C. §119 of Great Britain application No. 9828234.6, filed on Dec. 22, 1998. U.S. Pat. No. 6,543,552 claims benefit under 35 U.S.C. §119 of Great Britain application No. 9900835.1, filed on Jan. 15, 1999. U.S. Pat. No. 6,543,552 claims benefit under 35 U.S.C. §119 of Great Britain application No. 9923783.6, filed on Oct. 8, 1999. U.S. Pat. No. 6,543,552 claims benefit under 35 U.S.C. §119 of Great Britain application No. 9924189.5, filed on Oct. 13, 1999. All of the aforementioned related patent applications are herein incorporated by reference in their entirety.

BACKGROUND OF THE INVENTION

1. Field of the Invention

This invention relates to a drilling method and to drilling apparatus. In particular, aspects of the invention relate to combined bore drilling and bore isolation methods and apparatus.

2. Description of the Related Art

In oil and gas exploration and production operations, subsurface hydrocarbon-bearing formations are accessed by drilling bores from the surface to intersect with the formations. Drilling is accomplished using a drill bit mounted on the end of a drill support member, commonly known as a drill string. The drill string may be rotated via a top drive or rotary table on a surface platform or rig, or a downhole motor may be mounted towards the lower end of the string. The drilled bores are lined with steel tubing, known as "casing", which casing is cemented in the bore by filling the annulus between the casing and the surrounding bore wall with cement slurry. The casing inter alia supports the bore wall and prevents fluid flowing into or from the bore through the bore wall.

During a drilling operation it is normally the case that the drill string passes through an upper section of the bore, which is cased, and. a lower and more recently drilled bore section which is uncased. While drilling, it is not uncommon for the bore to intersect formations which create difficulties for the drilling operator, including: unstable formations which collapse into the bore; swelling formations which restrict the. bore and may trap the drill string in the bore; porous formations which result in loss of returning drilling fluid; and fluid-containing formations which result in uncontrolled flow of gas or liquid into the bore.

In some cases these difficulties may be overcome by, for example, pumping specialised fluids downhole to treat the problem formation. However, in other cases it may be necessary to retrieve the drill string and then run in casing or other bore liner to isolate the problem formation before drilling may recommence. Clearly, these operations will be time consuming and incur significant extra expense. Further, in the event of significant immediate problems, it may even become necessary to abandon the well.

In normal drilling operations, the sequence of events in drilling and then casing a bore is similar, that is following drilling to a desired depth the drill string is retrieved and a casing string is then made up and run into the bore.

It is among the objectives of embodiments of the present invention to provide a method and apparatus which permit bore drilling and bore isolation operations to be executed in a single "trip", that is a drill string need not be retrieved and a separate casing string run in prior to a bore lining or isolation operation being carried out.

SUMMARY OF THE INVENTION

According to the present invention there is provided a drilling method comprising: mounting a drill bit on a drill string including a section of expandable tubing; providing a tubing expander in the string; advancing the drill string through a bore; passing the expander through the expandable tubing to expand the tubing; and retrieving the drill bit from the bore, through the expanded tubing.

According to another aspect of the present invention there is provided drilling apparatus comprising: a drill string including a section of expandable tubing; a drill bit mounted on the string; and a tubing expander mounted on the string, whereby the expander is operable to expand the expandable tubing downhole such that the drill bit may be retrieved through the expanded tubing.

Thus, the invention allows a section of tubing to be expanded downhole to, for example, isolate a problem formation, and the drill bit to then be retrieved through the expanded tubing. In addition, in directional drilling, other equipment such as bent subs, motors and MWD apparatus will be mounted on the string and could also be retrieved through the expanded tubing. As the expandable tubing forms part of the drill string, conveniently forming the lowermost section of the drill string, the tubing may be put in place relatively quickly, as there is no requirement to retrieve the drill string and then run in a separate string of bore liner. The invention may also be utilised to drill and line a section of bore, which may not necessarily contain a problem formation, in a single trip. In such applications there may be occasions, for example, when the bore is not to be extended further, when the drill bit may not need to be retrieved and may be left in the sump of the bore.

The expanded tubing may be cemented in the bore.

The drill bit may be a bi-centre bit or a retractable or collapsible bit, to facilitate retrieval of the bit through the expanded tubing, and also to facilitate the drilling of relatively large bores below existing casing, as shown in FIG. 8.

When drilling below a cased section of bore it is preferred that the length of the expandable tubing section is selected to be greater than the length of the uncased section of bore, such that there is an overlap between the existing casing and the expandable tubing; the expandable tubing may be expanded at the overlap to engage the casing, and thus create a hanger for the expanded tubing. In other embodiments the expandable tubing may be otherwise located or secured in the bore.

Preferably, the expandable tubing forms the lower section of the drill string and a drill assembly, which may consist solely of the drill bit, but which may also include directional drilling apparatus, such as bent subs, motors and MWDs, is mounted to the lower end of the expandable tubing section.

Preferably, the tubing expander is initially located in an upper part of the expandable tubing, and is advanced downwards through the tubing to expand the tubing. Most preferably, the expander and the drill bit define corresponding profiles such that, following expansion of the tubing, the expander may engage the bit and allow the bit to be retrieved with the expander. Preferably also, the coupling between the expander and the drill bit is such that there may be a transfer of torque therebetween, allowing further drilling of the bore with the drill bit coupled to the expander; this may be useful to allow expansion of the lowermost part of the expandable tubing and drilling of a pocket beyond the end of the section of bore lined with the expanded tubing.

Preferably, the expandable tubing is deformed by compressive plastic deformation or yield of the tubing, with a localised reduction in wall thickness resulting in a subsequent increase in tubing diameter. Most preferably, the deformation is achieved by rolling expansion, that is an expander member is rotated within the tubing with a face in rolling contact with an internal face of the tubing.

Preferably, the tubing expander comprises a body and one or more rolling expander members mounted on the body. The one or more expander members may be radially extendable, or may be inclined to the tubing axis to define an expansion cone. To expand the tubing, the expander is rotated and advanced through the tubing. The tubing expander may comprise a plurality of expanding sections, and in the preferred embodiment two expanding sections are provided, a first section including a plurality of rollers in a conical configuration, and a second section in which the roller axes are substantially parallel to the tubing axis. The first section may provide a degree of initial deformation by a combination of compressive and circumferential yield, while the second section may provide a subsequent degree of deformation substantially by compressive yield. Other forms of expanders may be utilised, such as a. fixed cone or expansion mandrel, however the expansion mechanism of a fixed cone, that is substantially solely by circumferential yield, is such that the axial forces required to advance such a cone through expanding tubing are significantly greater than those required to advance a rolling expander through expanding tubing.

The tubing expander may be rotated from surface, or may be rotated by a downhole motor mounted to the string.

Preferably, the tubing expander is releasably axially and rotatably lockable relative to the expandable tubing, and thus may form the coupling between the expandable tubing and the remainder of the drill string. When it is desired to expand the tubing, the expander may be rotatably unlocked from the tubing. Preferably, this follows an initial deformation of a first portion of the tubing into engagement with existing casing to create an initial lock against rotation of the tubing relative to the surrounding casing. The expander is then rotated relative to the tubing to create at least a portion of a tubing hanger. The expander may then be axially unlocked to allow the expander to advance through the tubing. The lock against relative location may be provided by couplings between the expander and the tubing which are released on initial deformation of the tubing, and the axial lock may be provided via a releasable swivel.

In other embodiments it may be necessary or desirable to retain a small annulus between the expandable tubing and the casing. This allows the expanded tubing to be cemented and sealed using conventional means. Further, sufficient initial torque resistance may be provided by the expandable tubing to allow the rotary expander to initiate rotary expansion before there is any contact between the tubing and the casing; for example a ball may be dropped to allow actuation of a release tool between the expander end the tubing.

The advancement of the tubing expander through the tubing may be achieved by application of weight, or alternatively or in addition may be achieved or assisted by provision of a suitable tractor arrangement, as described in W093/24728, the disclosure of which is incorporated herein by reference. Such a tractor may include a plurality of rollers having skewed axes of rotation such that rotation of the tractor, with the rollers in contact with the surrounding tubing, produces an axial driving force. The rollers may be urged radially outwardly, by mechanical or preferably fluid pressure force, to grip the tubing and such that the tractor may also provide for a degree of expansion of the tubing.

The expandable tubing may take any suitable form, and may be solid wall tubing, slotted or otherwise perforated tubing, or may incorporate sections of sand screen or the like. If the expanded tubing is to serve to isolate problem formations then clearly solid tubing will be preferred. The tubing may be provided with a seal arrangement, such as an elastomeric coating at the lower end thereof. Such an arrangement may be useful in situations where drilling fluid losses are being experienced to a formation that has been previously drilled. Losses could be mitigated by such a seal arrangement and would permit removal of the bit under safer well control conditions.

The drill string may take any appropriate form, and may be formed from drill pipe or from a reeled support, such as coiled tubing.

The expandable tubing may be expanded to a diameter close to the diameter of the drilled bore, and may be expanded such that the tubing contacts the bore wall.

According to a further aspect of the present invention there is provided a drilling method comprising mounting a drill bit on a drill string including a section of expandable tubing; providing a tubing expander In the string; advancing the drill string through a bore; and passing the expander through the expandable tubing to expand the tubing by compressive yield.

According to a still further aspect of the present invention there is provided drilling apparatus comprising: a drill string including a section of expandable tubing; a drill bit mounted on the string; and a tubing expander mounted on the string, the expander having at least one rolling expander member, whereby the expander is operable to expand the expandable tubing downhole by rolling expansion to produce compressive yield.

BRIEF DESCRIPTION OF THE DRAWINGS

These and other aspects of the present invention will now be described, by way of example, with reference to the accompany drawings, in which.

DETAILED DESCRIPTION OF THE PREFERRED EMBODIMENT

Figure 1:
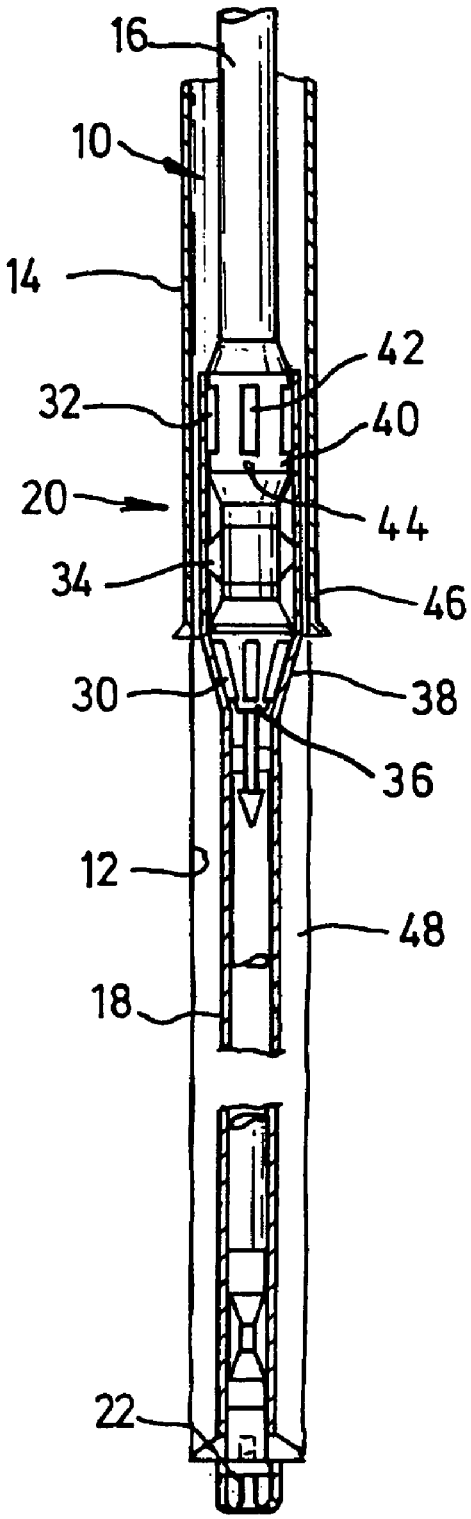
FIGS. 1 through 7 are schematic part sectional views showing the sequence of a bore drilling and isolation method in accordance with the preferred embodiment of the present invention.
Figure 2:
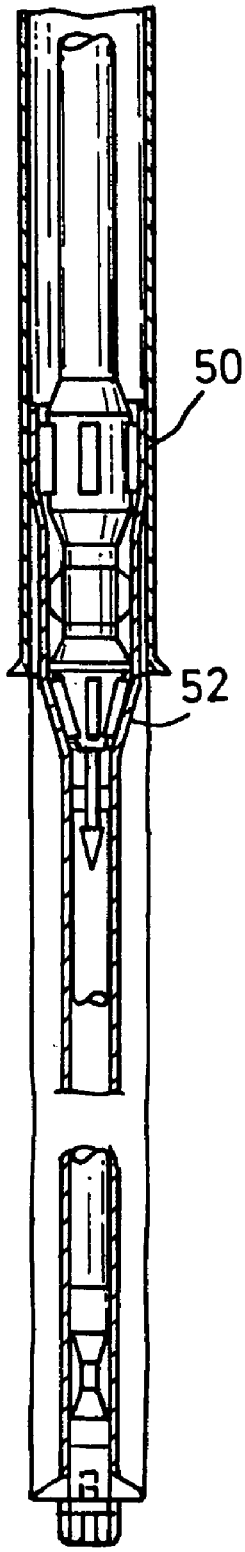
Figure 3:
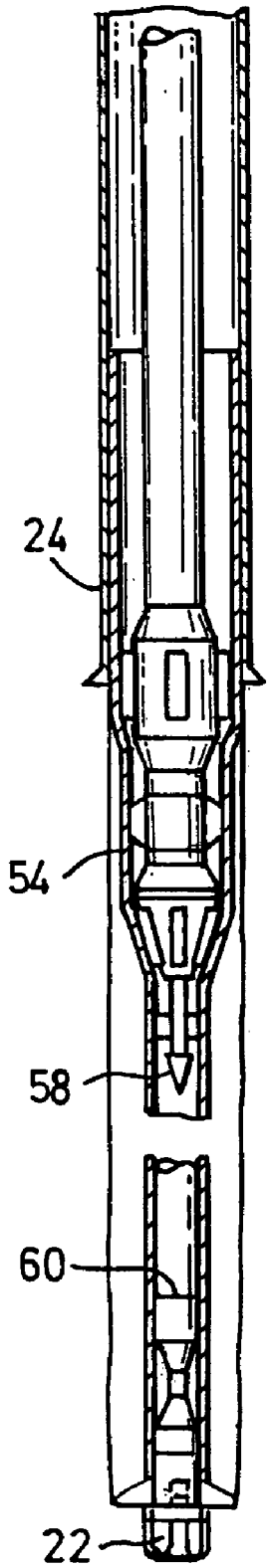
Figure 4:
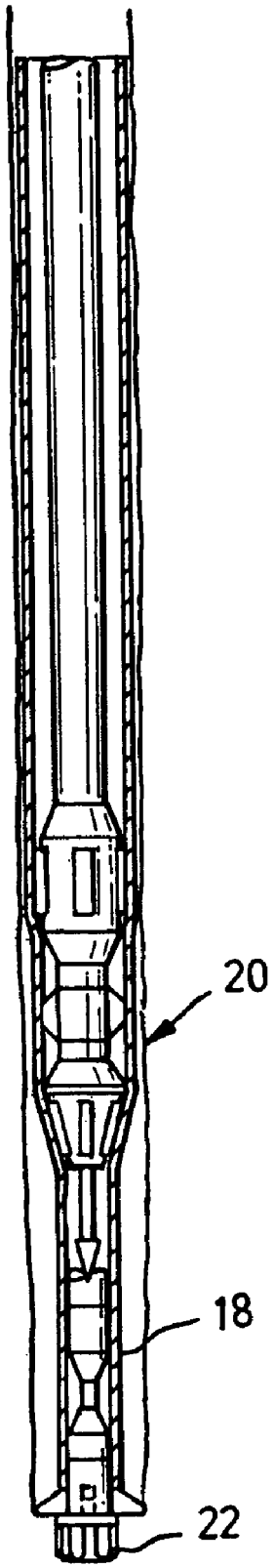
Figure 5:
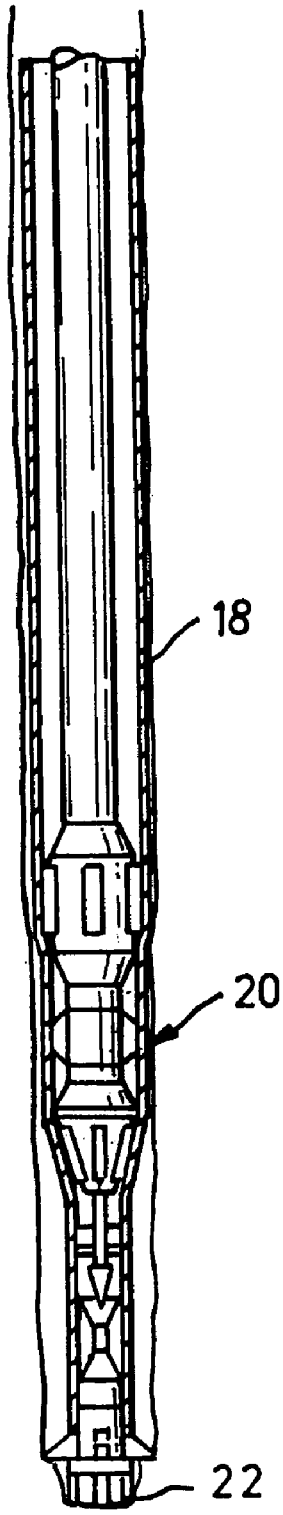
Figure 6:
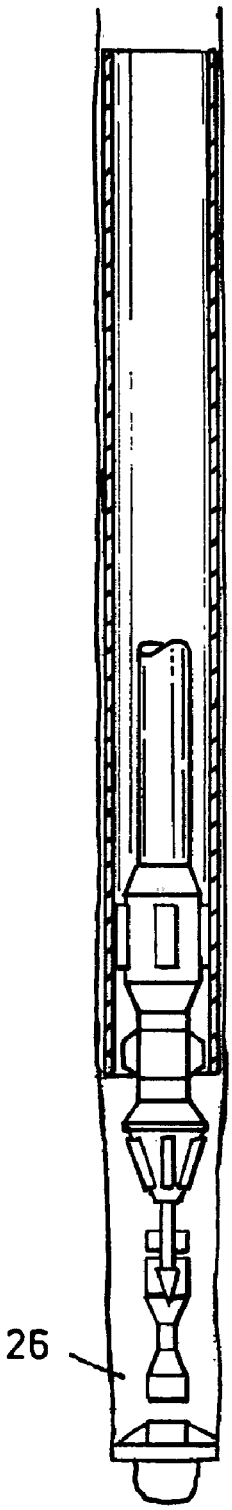
Figure 7:
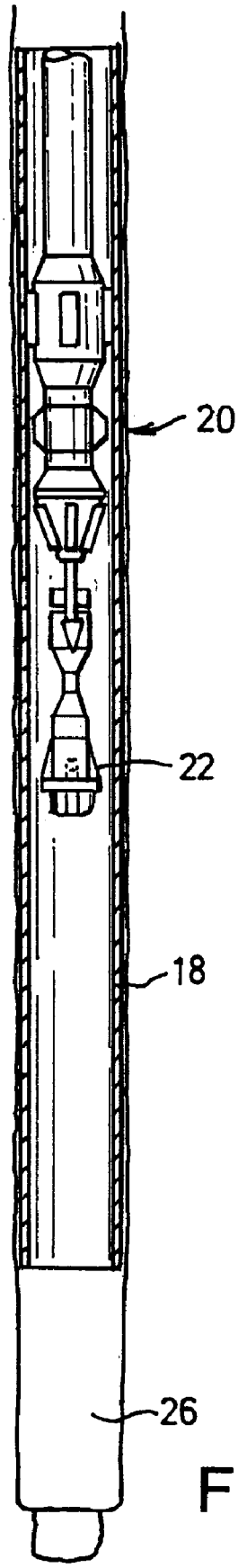
Figure 8:
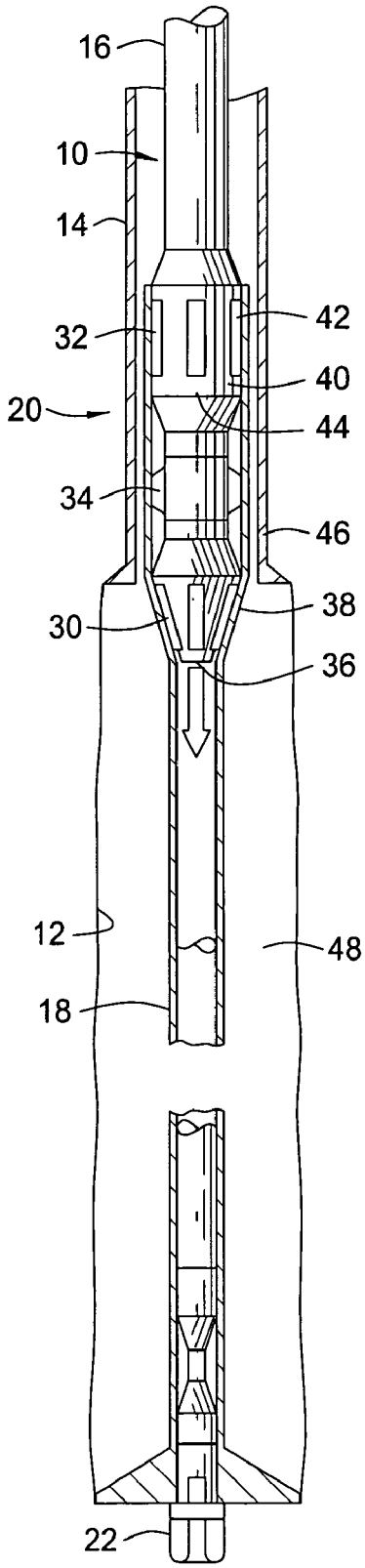
FIG. 8 shows drilling of relatively large bores below existing casing.

The drawings illustrate the sequence of a drilling operation in accordance with an embodiment of one aspect of the present invention, utilising apparatus of an embodiment of another aspect of the present invention. Reference is first made in particular to FIG. 1 of the drawings, which illustrates the lower section of a drill string 10 being utilised to drill and extend a bore 12 below an existing section of bore which has previously been lined with casing 14. The string 10 comprises conventional drill pipe 16, which extends to the surface, and a section of expandable tubing 18 coupled to the lower end of the drill pipe section 16 via an expander 20. The expandable tubing 18 extends through the uncased section of the bore 12 and provides mounting for a drill assembly including a collapsible drill bit 22. During drilling, the string 10 is rotated from surface and weight is also applied to the string 10, such that the drill bit 22 advances the bore 12. When the bore 12 has been drilled to the desired depth, the expander 20 is activated to form a tubing hanger 24 to locate the tubing relative to the casing 14 (see FIGS. 2 and 3). The expander 20 is then advanced through the tubing 18, and expands the tubing 18 to a diameter close to the bore diameter (FIG. 4). The expander 20 then engages the drill bit 22 (FIG. 5), and drilling may then recommence, beyond the end of the tubing 18, simultaneously with the expansion of the lower end of the tubing 18 (FIG. 6). The drill bit 22 is then collapsed and the string 10, including the expander 20 and the drill bit 22, may be retrieved, leaving the expanded tubing 18 in the bore with a pocket 26 therebelow.

The apparatus and method will now be described in greater detail. The expander 20 comprises first and second expander sections 30, 32, with a releasable swivel 34 therebetween. The first expander section 30 features a 20 conical body 36 which provides mounting for a number of inclined axis rollers 38, the roller axes and roller profiles being arranged such that there is minimal skidding between the rollers 38 and an adjacent conical contact surface. The second expander section 32 comprises a generally cylindrical body 40 carrying a plurality of parallel axis rollers 42. The rollers 42 are mounted on pistons and are radially extendable by application of elevated fluid pressure to the interior of the expander section body 40. Further, the second expander section body 40 carries coupling pins 44 which, initially at least, engage the upper end of the tubing 18 and allow transfer of rotational torque from the drill pipe 16, though the expander 20, to the tubing 18.

The swivel 34 engages the tubing 18 and, initially at least, provides axial support for the tubing 18.

The length of the tubing 18 is selected to correspond to the length of the uncased section of the bore which will extend beyond the end of the casing 14 following completion of an initial drilling stage, with allowance for a suitable overlap 46 between the lower end of the casing 14 and the upper end of the expandable tubing 18. FIG. 1 illustrates the point in the drilling operation when the initial drilling stage has been completed. It will be noted that the expander 20 is located in the upper end portion of the expandable tubing 18 which provides the overlap 46.

During the drilling operation, drilling mud will have been circulated through the drill string 10 to the drill bit 22, and returning through the annulus 48 between the tubing and the bore wall. On reaching the desired depth, as illustrated in FIG. 1, the flow of drilling fluid is increased, leading to an increase in the internal fluid pressure within the expander 20. This activates the second expander section, such that the rollers 42 are extended radially outwardly, and deform the upper end of the tubing 18 to create contact areas 50 between the tubing 18 and the casing 14 externally of the rollers 42. This deformation also disengages the tubing 18 from the pins 44. Thus, the expander 20 may then be rotated relative to the tubing 18, which is now fixed against rotation relative to the casing 14. The rotation of the expander 20, with the rollers 42 of the second expander section 32 radially extended, results in the deformation of the upper end of the expandable tubing 18 to create an annular section of increased diameter which forms an interference fit with the casing 14, and thus creates a tubing hanger 24. The rolling expansion of the tubing 18 results in the wall of the tubing 18 being subject to compressive yield, and the decrease of tubing wall thickness leading to a corresponding increase in tubing diameter.

The tubing 18 is now securely hung from the casing 14, and the swivel 34 may therefore be released, for example by virtue of a mechanism which is operable by a combination of application of elevated internal fluid pressure and axial force.

With the elevated fluid pressure still being applied to the expander interior, and the expander 20 being rotated, weight is applied to the string, resulting in the expander 20 advancing through the tubing 18.

The first expander section 30 is initially located in a cross-over portion of the tubing 52 where the diameter of the tubing 18 changes from a relatively small diameter to the larger diameter upper end accommodating the expander 20. During the expansion operation, the first expander section rollers 38 move in rolling contact around the inner wall of the tubing 18, and expand the tubing to an intermediate diameter 54 by a combination of circumferential and compressive yield. The second expander section 32 produces a further expansion of the tubing 18, mainly by virtue of compressive yield.

The first stage of the expansion operation continues until a profiled member 58 extending from the expander 20 engages a corresponding female profile 60 in the upper end of the drill bit 22. On engagement of the profiles 58, 60, the drill bit 22 rotates with the expander 20, and extends the bore beyond the lower end of the tubing 18. This allows the end portion of the tubing 18 to be expanded, and also provides an uncased pocket 26 at the end of the bore 12. The string 10 may then be retrieved from the bore, together with the expander 20 and drill bit 22.

It will be apparent to those of skill in the art that the above-described embodiment offers significant time savings over conventional drilling and casing operations as it allows for drilling of a section of bore, and location of casing in a bore, in a single trip. This may be useful in conventional drilling and casing operations, and also may be useful for isolating problem formations encountered during a drilling operation.

It will also be apparent to those of skill in the art that the above-described embodiment is merely exemplary of the present invention, and that various modifications and improvements may be made thereto, without departing from the scope of the present invention. In the above described embodiment, the expandable tubing is deformed initially to create a tubing hanger. In other embodiments a small gap or annulus may be provided between the expanded tubing and the casing, to facilitate cementing of the expanded tubing, and allowing use of other hanging and sealing arrangements. Also, in the above described embodiment a pocket is drilled beyond the end of the expandable tubing. In other embodiments, the expander may be provided with a female bit recovery device with a telescopic action, allowing complete expansion of the tubing without the need for further drilling. This may be desirable in situations where the bit has been blunted, nozzles have packed off, the bit has become stuck or other events have occurred that make drilling difficult or impossible.

In the above embodiment expander actuation is achieved by increasing pump rates. In other embodiments, particularly where there is no requirement to drill a pocket, the expander may be actuated by dropping a ball through the string to engage a sleeve or the like to permit opening of fluid passages to allow fluid pressure actuation of the expander.

What is claimed is:

1. A drilling method, comprising:

providing a drill string comprising:

an expandable tubular, a drill assembly having a drill bit, and a tubing expander tool;

advancing the drill string through a cased section of a wellbore;

advancing the expandable tubular through the wellbore below the cased section; and expanding at least a portion of the expandable tubular into the wellbore by contacting an outer surface of the expander tool with an inside of the expandable tubular, wherein upon expansion of substantially the entire length of the expandable tubular, the expandable tubular does not overlap the cased section of the wellbore.

2. The method of claim 1, further comprising rotating the drill bit and advancing the drill bit through the wellbore below the expandable tubular.

3. The method of claim 1, wherein advancing the expandable tubular through the wellbore below the cased section comprises locating an upper end of the expandable tubular below a lower end of the cased section of the wellbore.

4. The drilling method of claim 1, further comprising retrieving the tubing expander tool through the expanded tubular.

5. The method of claim 4, further comprising retrieving the drill bit with the tubing expander tool.

6. The method of claim 1, wherein advancing the drill string through the wellbore below the cased section comprises rotating the drill bit and advancing the expandable tubular to drill through the wellbore below the cased section.

7. The method of claim 1, wherein the drill bit is connected to the expandable tubular.

8. The method of claim 1, wherein the tubing expander tool is a mandrel.

9. The method of claim 8, wherein the mandrel is conical.

10. A drilling method, comprising:

running a drill string into a wellbore, the drill string comprising:

an expandable tubular, a drill assembly having a drill bit, and a tubing expander tool;

advancing the drill string through the wellbore;

expanding at least a portion of the expandable tubular into the wellbore by contacting an outer surface of the expander tool with an inside of the expandable tubular; and advancing the drill assembly below the expandable tubular further into the wellbore without removing the drill assembly from the wellbore.

11. The method of claim 10, further comprising rotating the drill bit while advancing the drill string through the wellbore.

12. The method of claim 10, further comprising rotating the drill bit while advancing the drill assembly below the expandable tubular.

13. The method of claim 10, wherein at least the portion of the expandable tubular overlaps a cased section of the wellbore.

14. The method of claim 10, wherein a section of the wellbore is cased and at least the portion of the expandable tubular is spaced apart from the cased portion.

15. The method of claim 10, wherein the drilling method is accomplished during one trip into the wellbore.

16. The method of claim 15, wherein the diameter of the expandable tubular is uniformly increased within the wellbore.

17. The method of claim 10, further comprising retrieving the drill bit through the expandable tubular.

18. The method of claim 10, further comprising cementing the expandable tubular within the wellbore.

19. The method of claim 10, wherein the drill string is provided on a string which is reelable from a surface of the wellbore.

20. A drilling apparatus comprising:

a drill string including a section of expandable tubing;

a drill bit attached to the drill string; and a tubing expander mounted on the drill string, wherein the expandable tubing is deformable by compressive plastic deformation of the tubing with a localized reduction in wall thickness, resulting in a subsequent increase in inner diameter, and wherein a lower portion of the expandable tubing has an external seal arrangement for cooperating with a surrounding wall of a wellbore.

21. An apparatus for lining and drilling a wellbore, comprising:

an expandable tubular;

a drill assembly comprising a drill bit; and a tubing expander comprising one or more radially retractable members that are directly retractable due to a decrease in fluid pressure, wherein the expandable tubular, the drill assembly and the tubing expander are all coupled together to provide a drill string capable of being run into the wellbore in one trip.

22. The apparatus of claim 21, wherein the tubing expander comprises a plurality of radially retractable members.

23. A drilling method comprising:

mounting a drill bit on a drill string including a section of expandable tubing and providing a tubing expander in the string, the tubing expander comprising one or more radially retractable members that are directly retractable in response to a decrease in fluid pressure;

advancing the drill string through a wellbore using the drill bit;

passing the expander through the expandable tubing to plastically deform at least a portion of the tubing; and decreasing fluid pressure directly behind the radially retractable members.

24. The method of claim 23, wherein the wellbore is drilled below a cased section of wellbore so that there is an overlap between the cased section and the expandable tubular.

25. The method of claim 23, wherein the radially retractable members are radially retracted to retrieve the tubing expander from the wellbore.

26. The method of claim 25, wherein the drill bit is retrieved with the tubing expander.

27. The method of claim 23, further comprising drilling a further portion of the wellbore below the expandable tubing using the drill bit.

28. A method of lining a wellbore, comprising:

providing a drilling assembly comprising:

an expandable tubular, a drill bit, and a tubing expander;

advancing the drilling assembly through the wellbore;

at least partially expanding the expandable tubular into the wellbore, wherein the entire length of the expandable tubular is expanded into an entirely uncased section of the wellbore, wherein the uncased section of wellbore is disposed below a cased section of wellbore; and filling an annulus between the expandable tubular and the wellbore surrounding the expandable tubular with cement.

29. The method of claim 28, wherein the drilling assembly is provided on a string which is reelable from a surface of the wellbore.

30. The method of claim 28, wherein at least a portion of the expandable tubular comprises a plurality of apertures therethrough.

31. The method of claim 30, wherein the portion of the expandable tubular includes one or more sections of expandable sand screen.

32. The method of claim 28, wherein the drilling assembly further comprises a mud motor.

33. The method of claim 32, wherein advancing the drilling assembly through the wellbore is accomplished using the mud motor.

34. The method of claim 33, wherein the drill bit is connected to a lower end of the expandable tubular.

35. The method of claim 28, wherein the drilling assembly further comprises one or more measuring-while-drilling tools.

36. The method of claim 28, wherein the drilling assembly further comprises one or more directional drilling tools.

37. The method of claim 28, wherein the wellbore is drilled below a cased section of wellbore and advancing the drilling assembly through the wellbore forms a relatively large bore below the cased section, the relatively large bore being relatively large compared to the wellbore having the casing section therein.

38. The method of claim 28, wherein advancing the drilling assembly through the wellbore comprises drilling through the wellbore using the expandable tubular.

39. The method of claim 38, wherein a downhole motor driving the drill bit is connected to the expandable tubular.

40. The method of claim 38, wherein at least partially expanding the expandable tubular into the wellbore comprises applying a radial load to the expandable tubular.

41. The method of claim 40, further comprising removing the radial load from the expandable tubular.

42. A method of drilling a wellbore, comprising:

providing a drilling assembly comprising:

an expandable tubular, at least a portion of the tubular comprising a plurality of apertures therethrough, and a drill bit;

advancing the drilling assembly through the wellbore;

placing the tubular within the wellbore; and at least partially expanding the portion into the wellbore.

43. The method of claim 42, wherein the portion of the tubular comprises one or more sections of expandable sand screen.

44. The method of claim 42, further comprising retrieving the drill bit through the tubular.

45. The method of claim 42, wherein the advancing, placing, and expanding is accomplished in one trip into the wellbore.

46. The method of claim 42, wherein the drilling assembly further comprises a tubing expander for at least partially expanding the portion into the wellbore.

47. A drilling method, comprising:

providing a drill string comprising:

an expandable tubular, and a drill assembly having a drill bit;

advancing the drill string through a cased section of a wellbore;

advancing the expandable tubular through the wellbore below the cased section, wherein, during the advancing of the expandable tubular, rotating the drill bit drills through formation below the cased section to extend the wellbore; and expanding at least a portion of the expandable tubular into the wellbore, wherein upon expansion of substantially the entire length of the expandable tubular, the expandable tubular does not overlap the cased section of the wellbore.

48. A drilling method, comprising:

running a drill string into a wellbore, the drill string comprising:

an expandable tubular, a drill assembly having a drill bit, and a tubing expander tool;

advancing the drill string through the wellbore;

expanding at least a portion of the expandable tubular into the wellbore by contacting an outer surface of the expander tool with an inside of the expandable tubular;

retrieving the tubing expander tool through the expandable tubular; and advancing the drill assembly below the expandable tubular further into the wellbore after the retrieving the tubing expander tool through the expandable tubular.

49. A method of lining a wellbore, comprising:

providing a drilling assembly comprising:

an expandable tubular, a drill bit, and a tubing expander;

advancing the drilling assembly through the wellbore, wherein, during the advancing of the drilling assembly, rotating the drill bit drills through formation to extend the wellbore; and at least partially expanding the expandable tubular into the wellbore, wherein the drill bit is not retrieved following expansion of the expandable tubular.

* * * * *